US006873297B1

(12) United States Patent
Posluszny

(10) Patent No.: US 6,873,297 B1
(45) Date of Patent: Mar. 29, 2005

(54) LICENSE PLATE FRAME WITH ANTENNA

(75) Inventor: Jerry C. Posluszny, LaGrange Park, IL (US)

(73) Assignee: Mobile Marks, Inc., Schiller Park, IL (US)

( * ) Notice: Subject to any disclaimer, the term of this patent is extended or adjusted under 35 U.S.C. 154(b) by 0 days.

(21) Appl. No.: 10/712,113

(22) Filed: Nov. 13, 2003

(51) Int. Cl.[7] ..... H01Q 1/32

(52) U.S. Cl. ..... 343/711; 343/713; 340/340; 340/693.5; 340/933

(58) Field of Search ..... 343/711, 713, 343/866, 867, 741, 742, 700 MS; 340/693.5, 933, 928

(56) References Cited

U.S. PATENT DOCUMENTS 6,025,784 A * 2/2000 Mish ..... 340/693.5
6,448,889 B1 * 9/2002 Hudson ..... 340/425.5
2002/0044069 A1 * 4/2002 Jenkinson ..... 340/928

* cited by examiner

*Primary Examiner*—Hoang V. Nguyen
(74) *Attorney, Agent, or Firm*—George H. Gerstman; Seyfarth Shaw LLP

(57) ABSTRACT

A license plate frame assembly comprises a license plate frame, a seat member attached to the license plate frame, and a first antenna carried at the seat member in a position facing at an angle from the vertical. Also, multiple antennas may be carried by the license plate frame.

27 Claims, 1 Drawing Sheet

LICENSE PLATE FRAME WITH ANTENNA

BACKGROUND OF THE INVENTION

With the advent of the global positioning satellite system, automobiles commonly are capable of utilizing this system to determine location on a moment-by-moment basis. This, of course, requires an antenna that is carried by the vehicle.

Similarly, cellular phone and other person communication (PCS) systems are also very popular as vehicle-mounted options, and they require antennas as well. Antennas for the various frequencies of such functions must be installed in the vehicle in which they are to be used, the term "vehicle" including, typically, ground vehicles, but also, as appropriate, including watercraft, aircraft, and the like.

It is, of course, desirable that the antennas should be inconspicuous. However, when they are hidden inside of the vehicle, such as under the dashboard, seats, or the like, they are surrounded by metal components, which can interfere with the functioning of the antennas. However, the display of such antennas in a non-covert manner on the outside of the vehicle is undesirable.

DESCRIPTION OF THE INVENTION

In accordance with this invention, a license plate frame assembly may be used to carry a global positioning satellite antenna, and also, as desired, additional antennas for different, desired systems such as cellular phone systems and other PCS systems such as pagers, wireless computer systems, e-mail systems, and other 2.4 GHz systems.

A plurality of antennas may be covertly mounted on a license plate frame, to provide multiple communication functions to the vehicle, where the antennas are outside of the vehicle for improved reception, but remain not readily noticeable (i.e. covert). Such antennas may, of course, be used for either or both transmitting and receiving signals.

In accordance with this invention, a license plate frame assembly comprises a license plate frame, having a seat member attached to the license plate frame. A first antenna is carried at the seat member in a position facing at an angle to the vertical, preferably with the antenna bottom positioned outwardly beyond the antenna top. Thus, when the first antenna is a global positioning or other type of satellite antenna, it may have an upward looking orientation, which can improve the signal reception from the satellite (and transmission to the satellite). At the same time, the antenna is outside of the vehicle, for significantly improved wireless communication.

Typically, the best signals are received if the angle of the first antenna, carried in the seat, is less than 90°, for example, from 30 to 60°, and specifically about 45° from the vertical and preferably facing with the antenna bottom extending outwardly beyond the top, as stated, and illustrated in the drawings. The first antenna and accompanying electronics, typically for a global positioning satellite system, can be enclosed by front and sidewalls of the seat member, and optionally it may be completely enclosed with a rear wall as well, for enclosing protection of the system.

As another aspect of the invention, a second antenna may also be carried by the license plate frame. The second antenna may be for a use other than global positioning. For example, it may be used as part of a cellular phone system or other mobile PCS system.

A mobile PCS system is basically defined as any mobile, vehicle mounted system for personal communications service. It may include hardware, software and network components such as transmission facilities, switching facilities, signaling facilities, and databases. Thus, it includes cellular phones, paging systems, and any other desired mobile data transmission system.

Also, a third antenna, and optionally a fourth antenna, may be carried on the license plate frame. Each of these antennas may be spaced from the first and second antennas, which are also spaced from each other, and each of the antennas may be for a function different from that of the other antennas, typically receiving and transmitting signals at differing frequencies.

Additionally, one of the carried antennas may be an oval band antenna, which may be carried within the typically squared-off loop of a typical license plate frame, or, if the frame is made of metal, it may comprise the license plate frame itself or a part thereof, or it may comprise an embedded wire in a plastic license plate frame.

While, each of the antennas present are typically for use with different frequencies, if desired, two physically separate antennas may be for the same function and frequency, either to magnify the signal sent or received, or one of them may serve as a spare antenna.

Typically, the antennas of this invention may be carried in a license plate frame which substantially comprises a non-metallic material, such as plastic, and in which the antennas are mounted in receptacles in the back of the frames, with an unbroken wall in front of them, the receptacles either having an open back or being fully closed off and sealed for protection of the antennas. Alternatively, the antennas may be embedded in the material of the license plate frame.

The various antennas typically are connected with connecting wires, which may be joined together into a cable which, in one embodiment, may extend from the license plate frame as a single cable comprising at least a plurality of, and typically all of, the antenna connector wires. This cable then extends to the interior of the vehicle, where the respective wires are divided again, to connect with interior communication units for use by the driver or other passengers.

DESCRIPTION OF THE DRAWINGS

Referring to the drawings.

DESCRIPTION OF SPECIFIC EMBODIMENTS

Figure 1:
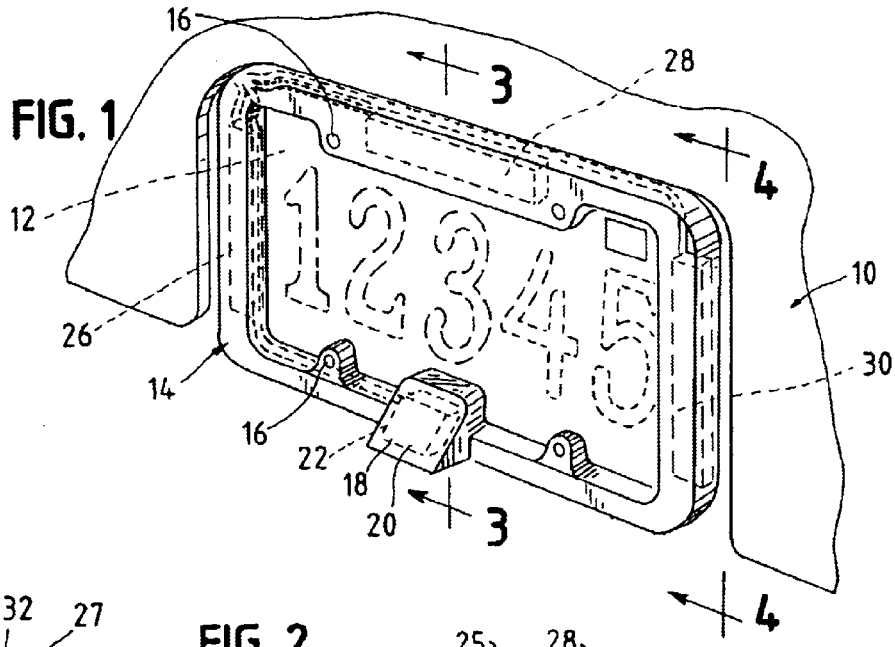
FIG. 1 is a fragmentary, perspective view of a vehicle which carries a license plate in a license plate frame assembly in accordance with this invention.

Referring to the drawings, FIG. 1 shows a vehicle 10, which may comprise any vehicle that carries a license plate, such as an automobile, truck, or bus, which carries a license plate 12 within a license plate frame 14 in a generally conventional manner. License plate frame 14 may be conventionally attached to the vehicle through bolt or screw access holes 16, and may generally be made of a durable plastic material such as plasticized PVC, or the like.

Figure 3:
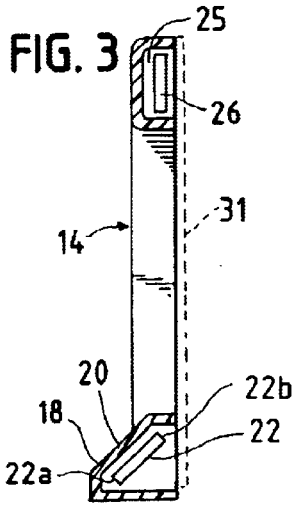
FIG. 3 is a sectional view, taken along line 3—3, of the license plate frame assembly.
Figure 4:
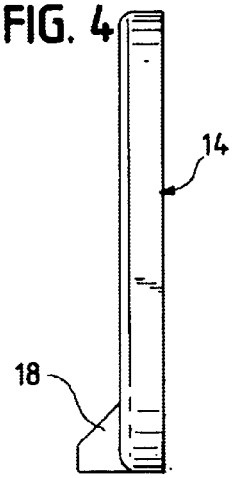
FIG. 4 is an elevational view, taken along line 44, of the license plate frame assembly.

In accordance with this invention, license plate frame 14 carries a seat member 18, which is typically integrally molded with the remainder of license plate frame 14. Seat 18 defines a forwardly extending, sloping wall 20, at about an angle of 45° to the vertical, as particularly shown in FIG. 3.

A ground positioning satellite sensor 22, which includes an antenna, is carried within seat 18, being typically conventionally retained at wall 20 so that sensor antenna 22 (the first antenna) assumes a similar angle of 45° from the vertical as it is retained at wall 20, with antenna bottom 22*a* extending outwardly beyond antenna top 226. Thus, global positioning satellite (GPS) antenna 22 is positioned outside of vehicle 10 and angled upwardly, to have better access to global positioning satellite signals.

Figure 2:
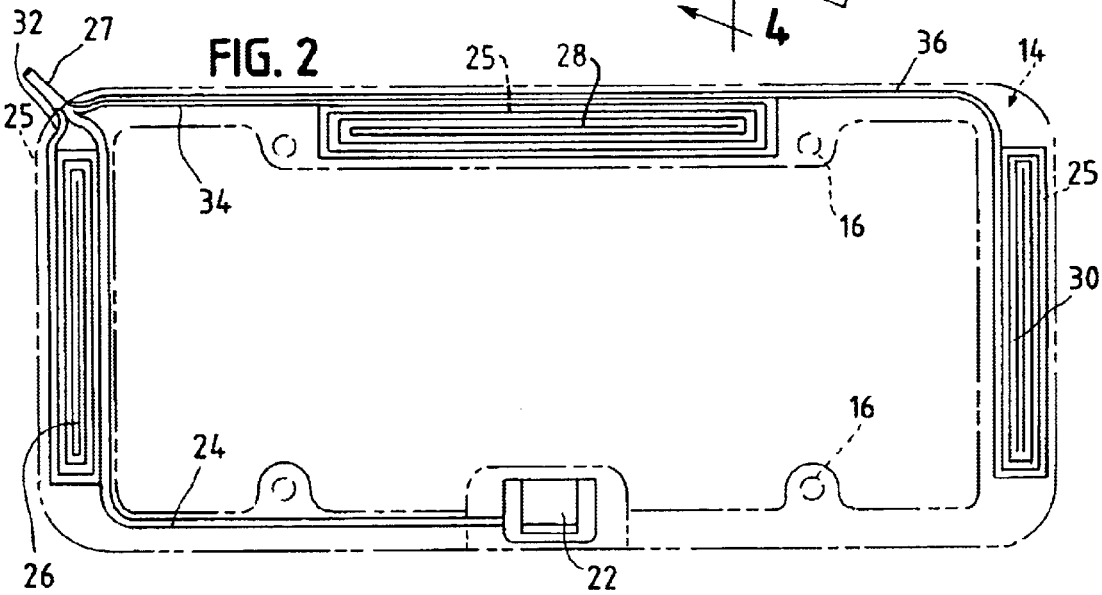
FIG. 2 is a rear, elevational view of the license plate frame assembly of FIG. 1.

As shown in FIG. 2, a wire 24 extends from first antenna 22 to join with other wires in a wrapped cable 27, which extends into the interior of vehicle 10. At that point, the various wires may divide again and extend to various components of their respective systems.

Furthermore, it can be seen that the license plate frame 14 carries three conventionally secured, additional antennas 26, 28, 30, each being carried in a receptacle 25. Each receptacle 25 is integrally formed in the typically molded license plate frame 14, to receive each of the respective antennas 26, 28, 30, in the manner specifically shown in FIG. 3 with respect to antenna 26, residing in a receptacle 25. The respective antennas 26, 28, 30, each in its receptacle 25, may be secured there in a recessed manner to provide a measure of protection from the elements. Alternatively, a back wall 31 may be applied for sealing of the respective antennas 22, 26, 28, 30 within license plate frame 14.

Each antenna 26, 28, 30 is respectively connected to a connector wire 32, 34, 36. These connector wires join with connector wire 24 of the first, GPS antenna 22, and form the length of wrapped cable 27, as described above.

While, as stated above, first antenna 22 may be part of a conventional GPS system, the other antennas may operate at different frequencies for different purposes. For example, antenna 26 may be for a cellular phone system. Antenna 28 may be for another kind of PCS system such as a pager or part of a wireless computer system. Antenna 30 may be for a conventional 2.4 GHz system.

It is not necessary to include all antennas as shown here. The same molded license plate frame 14 can carry from 14 antennas, so that any desired combination of antennas, for any desired combination of purposes, may be used, or, alternatively, the single, angled GPS antenna 22 may be the only antenna present, if that is desired. Thus, the frame of this invention may be used in a variety of electronic setups, which may be custom designed for the particular vehicle, while using the same license plate frame assembly.

The above has been offered for illustrative purposes only, and is not intended to limit the scope of the invention disclosed herein, which is as described in the claims below.

What is claimed is:

1. A license plate frame assembly which comprises: a license plate frame; a seat member attached to said license plate frame; and a first antenna carried at said seat member in a position facing at an angle to the vertical.

2. The assembly of claim 1 in which said angle is less than 90 degrees, and the bottom of the first antenna faces outwardly beyond the top.

3. The assembly of claim 1 in which said first antenna comprises a global positioning satellite antenna.

4. The assembly of claim 1 in which a second antenna is also carried on said license plate frame, the second antenna being for a use other than global positioning.

5. The assembly of claim 4 in which a third antenna is also carried on said license plate frame, said third antenna being spaced from the first antenna and second antenna.

6. The assembly of claim 5 in which the third antenna is for a function different from that of the first antenna and second antenna.

7. The assembly of claim 5 in which a fourth antenna is carried on the license plate frame.

8. The assembly of claim 4 in which said second antenna is for receiving signals at cellular, PCS, or 2.4 GHz frequencies.

9. The assembly of claim 8 in which a third antenna is carried on said license plate frame for a function different from that of the first antenna and the second antenna.

10. The assembly of claim 4 in which one of said antennas is an oval band antenna.

11. The assembly of claim 4 in which said antennas are mounted on the back of said frame.

12. The assembly of claim 4 in which each antenna is joined to a separate connector wire, and said connector wires are joined together as a cable extending away from the assembly.

13. The assembly of claim 1 in which said license plate frame is mostly made of a nonmetallic material.

14. A license plate frame assembly which comprises: a license plate frame; a first antenna, and a second antenna, each carried on said license plate frame, each antenna being for use with different frequencies from the other antenna.

15. The assembly of claim 14, in which a third antenna is carried on said license plate frame, each of said first, second, and third antennas being for use with different frequencies.

16. The assembly of claim 15 in which said second and third antennas are for receiving signals at cellular, PCS, or 2.4 GHz frequencies.

17. The assembly of claim 15 in which a fourth antenna is carried on the license plate frame.

18. The assembly of claim 14 in which said antennas are mounted on the back of said frame.

19. The assembly of claim 14 in which each antenna is joined to a separate connector wire, and said connector wires are joined together as a cable extending away from the assembly.

20. A license plate frame assembly which comprises: a license plate frame, and a seat member attached to the license plate frame, said seat member comprising a receptacle having a solid, forwardly facing wall, which seat member is proportioned to carry a first antenna within said seat member in a position facing at an angle from the vertical.

21. The license plate frame of claim 20 in which said angle is less than 90 degrees, said seat member having an angled face of less than 90 degrees, where the face bottom extends outwardly beyond the face top.

22. The license plate frame of claim 20 in which a receptacle for a second antenna is also defined by said license plate frame, said receptacle also having a solid, forwardly facing wall.

23. The license plate frame of claim 22 in which another receptacle for receiving a third antenna is also carried on said frame, said third antenna receptacle also defining a solid, forwardly facing wall.

24. The license plate frame of claim 20 which carries an oval band antenna.

25. The license plate frame of claim 20 which is mostly made of a nonmetallic material.

26. A license plate frame which carries at least a pair of receptacles for receiving first and second antennas, said receptacles each comprising a solid, forwardly facing wall.

27. The license plate frame of claim 26 in which at least one added said receptacle for at least one more antenna is defined by said license plate frame.

* * * * *